US006931377B1

(12) United States Patent
Seya

(10) Patent No.: US 6,931,377 B1
(45) Date of Patent: Aug. 16, 2005

(54) INFORMATION PROCESSING APPARATUS AND METHOD FOR GENERATING DERIVATIVE INFORMATION FROM VOCAL-CONTAINING MUSICAL INFORMATION

(75) Inventor: Kenji Seya, Tokyo (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/297,038

(22) PCT Filed: Aug. 28, 1998

(86) PCT No.: PCT/JP98/03864

§ 371 (c)(1),
(2), (4) Date: Aug. 24, 1999

(87) PCT Pub. No.: WO99/12152

PCT Pub. Date: Mar. 11, 1999

(30) Foreign Application Priority Data

Aug. 29, 1997 (JP) ..... 9/234127

(51) Int. Cl.[7] ..... G10L 11/00
(52) U.S. Cl. ..... 704/277; 434/307 A
(58) Field of Search ..... 434/307 A; 704/277

(56) References Cited

U.S. PATENT DOCUMENTS 4,852,170 A * 7/1989 Bordeaux ..... 704/277
5,546,500 A * 8/1996 Lyberg ..... 704/277
5,613,909 A * 3/1997 Stelovsky ..... 434/307 A
5,782,692 A * 7/1998 Stelovsky ..... 434/307 A

* cited by examiner

*Primary Examiner*—David D. Knepper
(74) *Attorney, Agent, or Firm*—Jay H. Maioli

(57) ABSTRACT

An information processing apparatus for separating input musical number information into a vocal information part containing lyrics in a first language and an accompaniment information part, and for producing second musical number information made of the accompaniment part and a translated vocal information part superimposed thereon. A vocal separation unit separates the first vocal information part and the accompaniment information part from the input first musical information. A processing unit generates first language lyric information by speech recognition of the separated first vocal information part, translates the generated first language lyric information into second language lyric information, and supplies the second language lyric information. A synthesis unit synthesizes the supplied second language lyric information, the accompaniment information part, and the separated first vocal information part to generate second musical information. The second musical information includes the accompaniment information part and a second language vocal information part.

19 Claims, 10 Drawing Sheets

INFORMATION PROCESSING APPARATUS AND METHOD FOR GENERATING DERIVATIVE INFORMATION FROM VOCAL-CONTAINING MUSICAL INFORMATION

TECHNICAL FIELD

This invention relates to an information distribution system in which the information is distributed to an information transmission apparatus from an information storage apparatus storing the information, and in which the information received by the information transmission apparatus is outputted to enable the copying of the information, and to an information processing apparatus provided in this information distribution system to execute required information processing.

BACKGROUND ART

The present Assignee has already proposed an information distribution system in which the information such as a large number of musical number data (audio data) or picture data as a database in a server device, the portion of the voluminous data information required or desired by the user is distributed to a large number of intermediate server devices, and in which data of the intermediate server devices specified by the user is copied (downloaded) to a portable terminal device personally owned by the user.

For example, if, in the above-mentioned information distribution system, the service configuration in case of downloading the musical number data to a portable terminal device is scrutinized, it may in general be contemplated that audio signals of plural musical numbers on the musical number basis or on the album basis are digitized and stored in the server device and the musical numbers thus digitized are transmitted from the server device via the intermediate server devices to the user's portable terminal devices.

DISCLOSURE OF THE INVENTION

If the digitized information is transmitted, not only the digitized musical number information, but also the various secondary derivative information, generated concomitantly to the sole musical number information by processing digital data of a sole musical number as a raw material, may be furnished to a user of a portable terminal device. If such derivative information can be furnished to the user of the portable terminal device, the use value of the information distribution system is improved further. That is, an object of the present invention is to provide an information processing method and apparatus that is able to generate various derivative information from the musical number information to furnish it to the user.

The information processing apparatus according to the present invention includes a separating unit for separating the lyric information part and the accompaniment information part from the input information, a processing unit for generating the first language letter information by speech recognition of the lyric information part, converting the first language letter information into the second language letter information of a language different from that of the first language letter information and for generating the speech information using at least the second language letter information, and a synthesis unit for synthesizing the speech information and the accompaniment information to generate the synthesized information.

The information processing apparatus according to the present invention includes a processing unit for generating the first language letter information, converting the first language letter information into the second language letter information of a language different from that of the first language letter information and for generating the speech information using at least the second language letter information and a synthesis unit for synthesizing the speech information and the accompaniment information to generate the synthesized information.

In the information processing method according to the present invention, the lyric information part and the accompaniment information part are separated from the input information, the first language letter information is generated by speech recognition of the lyric information part and the first language letter information is converted into the second language letter information of a language different from that of the first language letter information. At least the second language letter information is used to generate the speech information which is synthesized to the accompaniment information to generate the synthesized information.

The information processing apparatus according to the present invention includes an information storage unit in which are stored plural information and at least one signal processing unit connected to the information storage unit. This information processing unit includes a separation unit for separating the lyric information part and the accompaniment information part from the information read out from the information storage unit, a processing unit for generating the first language letter information by speech recognition of the lyric information part, converting the first language letter information into the second language letter information of a language different from that of the first language letter information and for generating the speech information using at least the second language letter information, and a synthesis unit for synthesizing the speech information and the accompaniment information to generate the synthesis information.

The information processing method according to the present invention separates at least the speech information part from the input information, generates the first language letter information by speech recognition of the speech information part to generate the first language letter information and converts the first language letter information into the second language letter information of a language different from that of the first language letter information. At least the second language letter information is used to generate the speech information.

BRIEF DESCRIPTION OF THE INVENTION

BEST MODE FOR CARRYING OUT THE INVENTION

Figure 1:
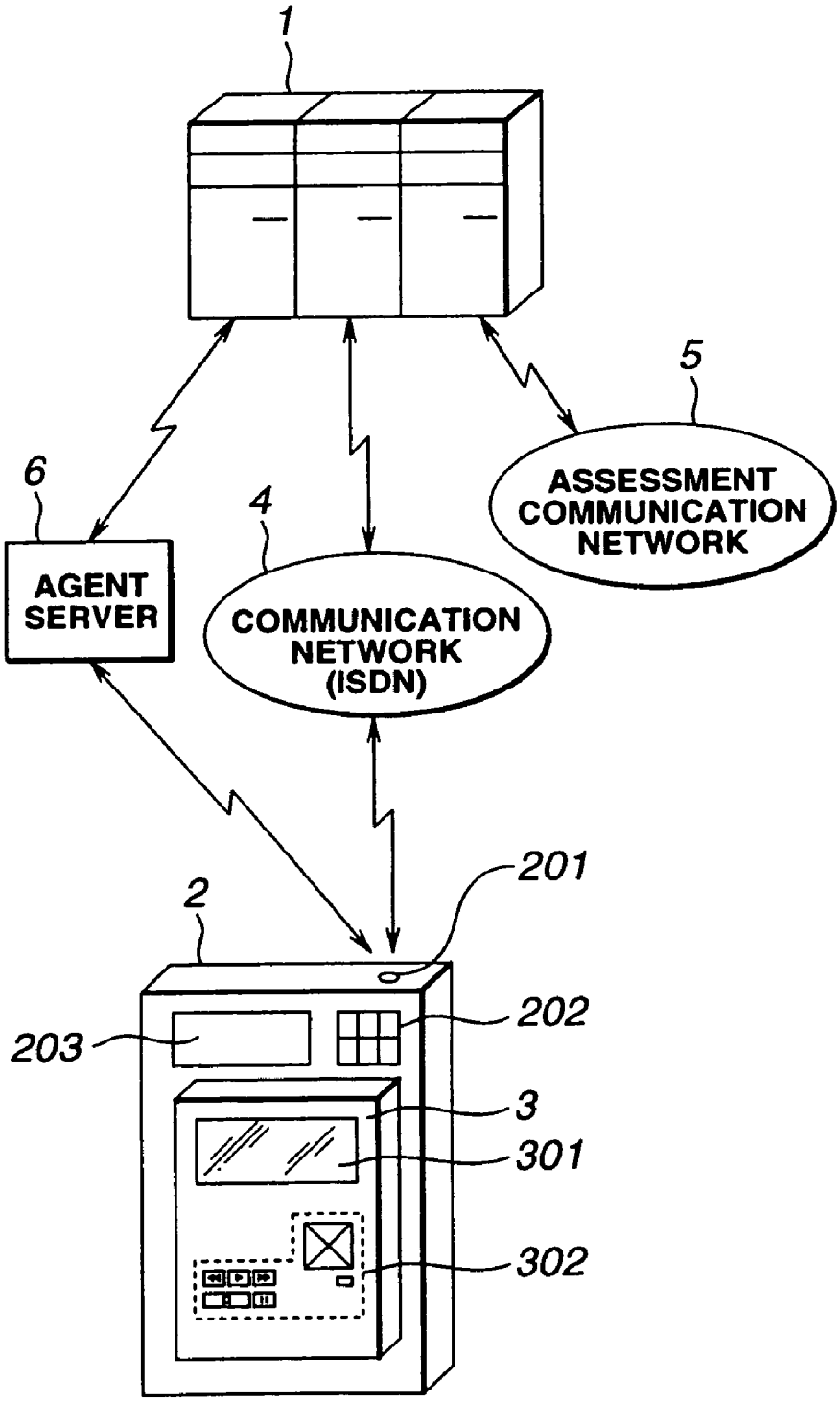
FIG. 1 is a block diagram showing a specified structure of an information distribution system embodying the present invention.

Referring to the drawings, preferred embodiments of the information processing method and apparatus of the present invention will be explained in detail, the following explanation is made in the following sequence:

1. Specified Structure of the Information Distribution System
1-a Schematics of Information Distribution System
1-b Specified Structure of Respective Components making up the Information Distribution System
1-c Specified Structure of Vocal Separation Unit
1-d Specified Structure of Speech Recognition Translation Unit
1-e Specified Structure of Speech Synthesis Unit
1-f Basic Downloading Operation and Typical Utilization of Downloading Operation
2. Downloading of Derivative Information

1. Specified Structure of the Information Distribution System

1-a Schematics of Information Distribution System

FIG. 1 is a block diagram showing a specified structure of an information distribution system embodying the present invention.

Referring to FIG. 1, a server device 1 includes a recording medium of a large recording capacity for storing the required information primarily including the data for distribution, such as audio information, text information, image information or the picture information as later explained, and is able to communicate with a large number of intermediate transmission devices 2 over at least a communication network 4. For example, the server device 1 receives the request information transmitted via communication network 4 from the intermediate transmission device 2 to retrieve the information designated by the request information from the information recorded on the recording medium. This request information is generated by the user of the portable terminal device 3 as later explained making a request for the desired information to the portable terminal device 3 or the intermediate transmission device 2. The server device 1 sends the information obtained on retrieval to the intermediate transmission device 2 via communication network 4.

In the present embodiment, assessment is made for the user when the information downloaded from the server device 1 via the intermediate transmission device 2 as later explained is copied (downloaded) to the portable terminal device 3 or when the portable terminal device 2 is electrically charged using the intermediate transmission device 2. This assessment is done via an assessment communication network 5 so that the fee is collected from the user. This assessment communication network 5 is constituted by, for example, the communication medium, such as a telephone network, with the server device 1 being connected via the assessment communication network 5 to a computer device of banking facilities which have made contract in connection with payment of the use fee of the information distribution system.

On the intermediate transmission device 2 can be attached the portable terminal device 3. The intermediate transmission device 2 mainly has the function of receiving the information sent mainly from the server device 1 by a communication control terminal 201 and outputting the received information to the portable terminal device 3. The intermediate transmission device 2 also has a charging circuit for electrically charing the portable terminal device 2.

The portable terminal device 3 is loaded on (connected to) the intermediate transmission device 2 so that it is able to communicate with or to be fed with power from the intermediate transmission device 2. The portable terminal device 3 records the information outputted by the intermediate transmission device 2 in an enclosed recording medium of a pre-set sort. The secondary cell, enclosed in the portable terminal device 2, is electrically charged by the intermediate transmission device 2 if so desired.

Thus, the information distribution system of the present embodiment is a system which has realized the so-called data-on-demand of copying the information of the large amount of the stored information in the server device 1, as requested by the user of the portable terminal device 3, on a recording medium of the portable terminal device 3.

There is no particular limitation to the communication network 4, such that it is possible to utilize CATV (cable televison, community antenna television), communication satellite, public telephone network or wireless communication. It is noted that the communication network 4 is able to perform bidirectional communication in order to realize the on-demand function. However, if a pre-existing communication satellite, for example, is used, the communication is unidirectional. In such case, another communication network 4 may be used for the opposite direction communication. That is, two or more communication networks may be used in conjunction.

On the other hand, for directly sending the information from the server device 1 to the intermediate transmission device 2 over the communication network 4, it is necessary to connect the network to all of the intermediate transmission devices 2 from the server device 1, thus raising the cost in the infrastructure. Moreover, the request information is concentrated in the server device 1 and, in order to meet these requests, the server device 1 has to send data to these intermediate transmission devices, thus raising the load imposed on the server device 1. Thus, it is possible to provide an agent server 6 between the server device 1 and the intermediate transmission device 2 for transient data storage in the server device 1 to save the network length. In addition, the agent server 6 may be used for downloading the data of high use frequency or the latest data from the server device 1 so that the information in meeting with the request information can be downloaded to the portable terminal device 3 solely by the data communication between the agent server 6 and the intermediate transmission device 2.

Referring to the perspective view of FIG. 2, the intermediate transmission device 2 and the portable terminal device 3 loaded on this intermediate transmission device 2 will be explained specifically. Meanwhile, the parts or components of FIG. 2 used in common with those of FIG. 1 are depicted by the same reference numerals.

The intermediate transmission devices 2 are arranged in kiosk shops in the railway stations, convenience stores, public telephone boxes or households. Each intermediate transmission device 2 has, on the front side of its main body portion, a display unit 203 for optionally displaying the required contents associated with the operations and a key actuating unit 202. On the upper surface of the main body portion of the intermediate transmission device 2 is mounted a communication control terminal 201 for communicating with the server device 1 over the communication network 4 as described above.

The intermediate transmission device 2 is also provided with a terminal device attachment portion 204 for attaching the portable terminal device 3. This terminal device attachment portion 204 has an information input/output terminal 205 and a power supply terminal 206. When the portable terminal device 3 is mounted on the terminal device attachment portion 204, the information input/output terminal 205 is electrically connected to an information input/output terminal 306 of the portable terminal device 3, while the power supply terminal 206 is electrically connected to a power input terminal 307 of the portable terminal device 3.

The portable terminal device 3 has a display unit 301 and a key actuating unit 302. The display unit 301 is designed to perform display responsive to the actuation or operations which the user made using the key actuating unit 302. The key actuating unit 302 includes a selection key 303 for selecting the requested information, a decision key 304 for definitively setting the selected request information and actuating keys etc. The portable terminal device 3 is able to reproduce the information stored in the recording medium held therein. The actuating keys 305 are used for reproducing the information.

On the bottom surface of the portable terminal device 3 are provided an information input/output terminal 306 and a power input terminal 307. When the portable terminal device 3 is loaded on the intermediate transmission device 2, as described above, the information input/output terminal 306 and the power input terminal 307 are connected to the information input/output terminal 205 and the power supply terminal 206 of the intermediate transmission device 2. This enables information input/output between the portable terminal device 3 and the intermediate transmission device 2 while allowing to use the power source circuit in the intermediate transmission device 2 to supply the power to the portable terminal device 3 and to electrically charge the secondary cell thereof.

On the upper surface of the portable terminal device 3, there are mounted an audio output terminal 309 and a microphone terminal 310 and, on the lateral surface thereof, there are mounted a connector 308 for connection to an external display device, a keyboard, a modem, a terminal adapter etc. These components will be explained subsequently.

Meanwhile, the display unit 203 and the key actuating unit 202 provided on the intermediate transmission device 2 may be omitted to diminish the function taken over by the intermediate transmission device 2 and, in their stead, the display unit 301 and the key actuating unit 302 may be utilized to carry out similar display and actuation.

Figure 2:
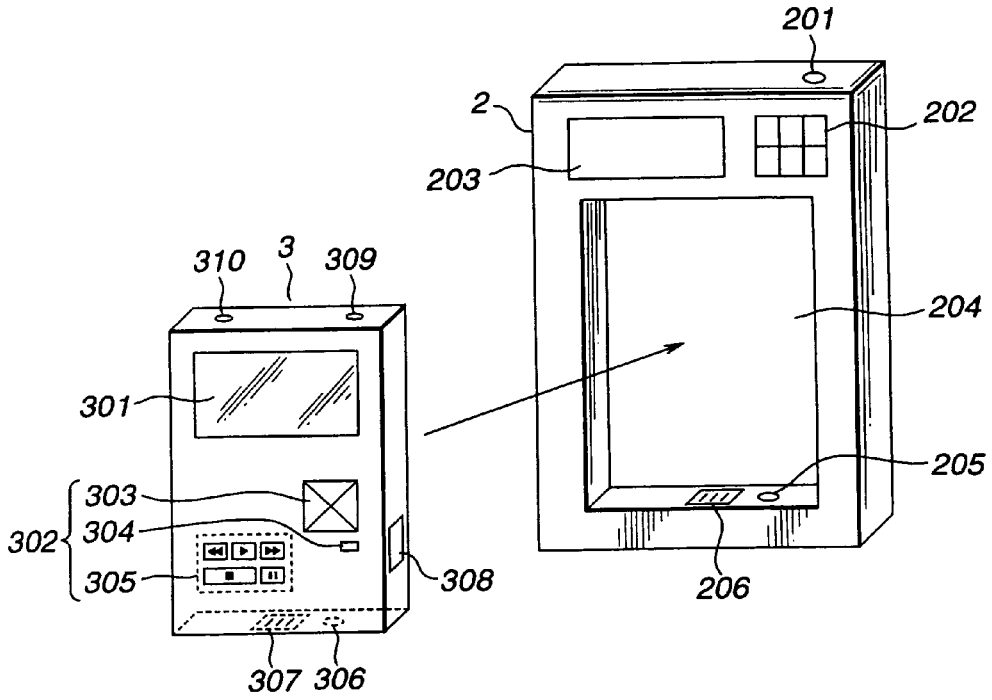
FIG. 2 is a perspective view showing the appearance of an intermediate transmission device and a portable terminal device.

The portable terminal device 3 can be attached to or detached from the intermediate transmission device 2, as shown in FIG. 2 or FIG. 1. However, since it suffices if the information input/output with respect to the intermediate transmission device 2 or the power supply from the intermediate transmission device 2 is possible, a power supply line or an information input line having a small-sized attachment from a required position such as a bottom surface, lateral surface or a terminal portion of the portable terminal device 3 can be lead out to connect this attachment portion to a connection terminal provided on the intermediate transmission device 2. Since it is felt to be possible that plural users possess their own portable terminal devices and access the sole intermediate transmission device 2 simultaneously, it is also possible to attach or connect the plural portable terminal devices 3 to the sole intermediate transmission device.

Figure 3:
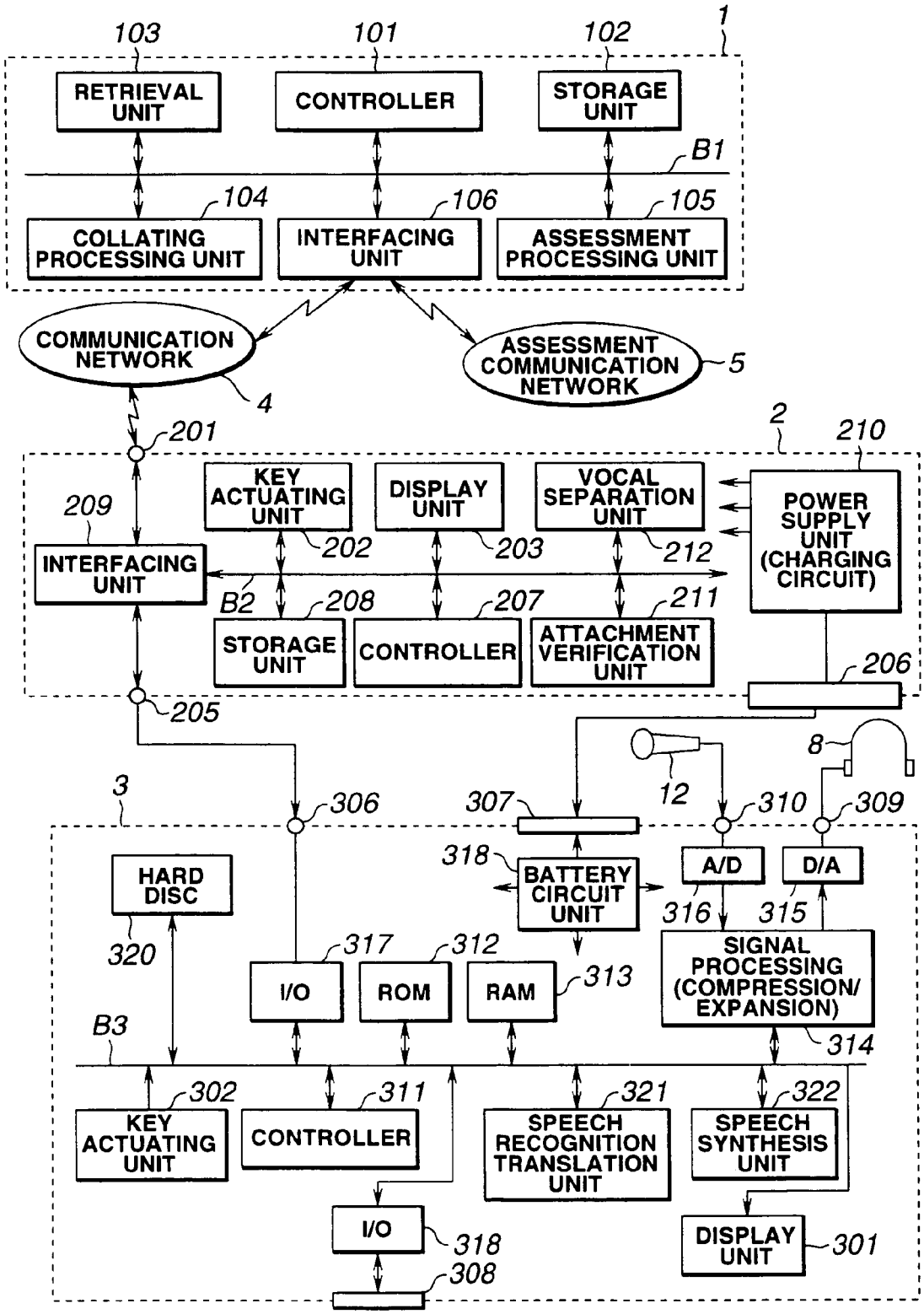
FIG. 3 is a block diagram showing a specified structure of various components making up an information distribution system.

1-b Specified Structure of Respective Components making up the Information Distribution System Referring to the block diagram of FIG. 3, specified structures making up the information distribution system (server device 1, intermediate transmission device 2 and the portable terminal device 3) are explained. In FIGS. 1 and 2, the same parts are indicated by the same reference numerals.

The server device 1 is first explained.

Referring to FIG. 3, the server device 1 includes a controller 101 for controlling various components of the server device 1, a storage unit 102 for storage of data for distribution, a retrieval unit 103 for retrieving required data from the storage unit 102, an assessment processing unit 105 for assessment processing for the user and an interfacing unit 106 for having communication with the intermediate transmission device 2. These circuits are interconnected over a busline B1 over which to exchange data.

The controller 101 is comprised of, for example, a microcomputer, and is adapted to control, the various circuits of the server device responsive to the control information supplied from the communication network 4 via the interfacing unit 106.

The interfacing unit 106 communicates with the intermediate transmission device 2 via the communication network 4. In the drawing, the agent server 6 is not shown for clarity. As the transmission protocol, used for transmission, a unique protocol or TCP/IP (Transmission Control Protocol/Internet Protocol) transmitting data generally used on the Internet by packets, may be used.

The retrieval unit 103 retrieves required data from the data stored in the storage unit 102 under control by the controller 101. For example, the retrieving processing by the retrieval unit 103 is performed on the basis of the request information transmitted from the intermediate transmission device 2 over the communication network 4 and which is sent via the interfacing unit 106 to the controller 101.

The storage unit 102 includes a recording medium of large storage capacity, and a driver for driving the recording medium. In the storage unit 102, there are stored various information, in addition to the above-mentioned distribution data, such as terminal ID data set from one portable terminal device 3 to another, and user-related data, such as the assessment setting information, as the database. Although a magnetic tape used in the current broadcast equipment may be among the recording mediums of the storage unit 102, it is preferred to use a random-accessible hard disc, a semiconductor memory, optical disc or a magneto-optical disc in order to realize the on-demand function characteristic of the present information distribution system.

Since the storage unit 102 is in need of storing a large quantity of data, it is preferably in a compressed state. For compression, a variety of techniques, such as MDCT (Modified Discrete Cosine Transform), TWINVQ (Transform Domain Weighted Interleave Vector Quantization) (Trademark), as disclosed in Japanese Laying-Open Patent H-3-139923 or 3-139922. There is, however, no particular limitation if the compression method permits data expansion in, for example, the intermediate transmission device 2.

The portable terminal device 3 sends its terminal ID data with request information to the server device 1 when first connected to the intermediate transmission device 2. A collation processing unit 104 collates the terminal ID data of the portable terminal device 3 with the terminal ID data of the portable terminal devices currently authorized to use the information distribution system. A pre-existing subscription list of authorized portable terminal devices (for example those that have paid a use fee) is stored as user-related data in the storage unit 102. The collation processing unit 104 sends the results of collation to the controller 101. Based on the results of collation, the controller then decides whether the information distribution system is or is not permitted to be used by the portable terminal device 3 loaded on the intermediate transmission device 2.

Under control by the controller 101, the assessment processing unit 105 performs assessment processing to determine the use fee amount needed to meet the state of use of the information distribution system by the user in possession of the portable terminal device. If, for example, the request information for information copying or electrical charging is sent from the intermediate transmission device 2 over the communication network 4 to the server device 1, the controller 101 sends the information coincident with the request information or data for permission of electrical charging. Based on the transmitted request information, the controller 101 grasps the state of use in the intermediate transmission device 2 or in the portable terminal device 3, and controls the assessment processing unit 105 so that the use fee amount of needed to meet with the actual state of use will be set in accordance with a pre-set rule.

The intermediate transmission device 2 is now explained.

Referring to FIG. 3, the intermediate transmission device 2 includes a key actuating unit 202, actuated by a user, a display unit 203, a controller 207 for controlling various parts of the intermediate transmission device 2, a storage unit 208 for transient information storage, an interfacing unit 209 for communication with the portable terminal device 3, and a power supply unit 210, including a charging circuit, for supplying the power to the various parts. The intermediate transmission device 2 also includes an attachment verification unit 211 for verifying the attachment or non-attachment of the portable terminal device 3, and a vocal separation unit 212 for separating the musical number information into the vocal information and the karaoke information. These circuits are interconnected over a busline B2.

The control circuit 207 is made up of, for example, a micro-computer, and controls the various circuits of the intermediate transmission device 2 if so required. The interfacing unit 209 is provided between the communication control terminal 201 and the information input/output terminal 205 in order to permit communication with the server device 1 or with the portable terminal device 3 via communication network 4. That is, there is provided an environment of communication between the server device 1 and the portable terminal device 2 via this interfacing unit 209.

The storage unit 208 is made up of, for example, a memory, and store information transiently. The controller 207 controls writing the information into the storage unit 208 and reading-out the information from the storage unit 208.

The vocal separation unit 212 separates the musical number information, among the distribution information downloaded from the server device 1, containing the desired vocal, into the vocal part information (vocal information) and the accompaniment part information other than the vocal part (karaoke information) to output the separated information. The specified circuit structure of the vocal separation unit 212 will be explained subsequently.

The power supply unit 210 is constituted by, for example, a switching converter, and converts the ac current supplied from a commercial ac power source, not shown, into a dc current of a pre-set voltage to send the converted dc current to respective circuits of the intermediate transmission device 2. The power supply unit 210 also includes an electrical charging circuit for electrically charging the secondary battery of the portable terminal device 3 and sends the charging current to the secondary battery of the portable terminal device 3 via the power supply terminal 206 and the power source input terminal 307 of the portable terminal device 3.

The attachment verification unit 211 verifies whether or not the portable terminal device 3 has been attached to the terminal device attachment portion 204 of the intermediate transmission device 2. This attachment verification unit 211 is constituted by, for example, a photointerrupter or a mechanical switch, and verifies the attachment/non-attachment based on a signal obtained on loading the portable terminal device 3. It is also possible to provide the power supply terminal 206 or the information input/output terminal 205 with a terminal, the conducting state of which is varied on loading the portable terminal device 3 on the intermediate transmission device 2, and to verify the attachment/non-attachment based on the variation in the current conducting state.

The key actuating unit 202 is provided with a variety of keys, as shown for example in FIG. 2. If the user actuates the key actuating unit 202, the actuation input information corresponding to the actuation is sent over the busline B2 to the controller 207, which then executes required control operations responsive to the supplied actuation input information.

The display unit 203 is made up of, for example, a liquid crystal device or a CRT (cathode ray tube) and its display driving circuit etc, and is provided exposed on the main body portion of the intermediate transmission device 2. The display operation of the display unit 203 is controlled by the controller 207.

The portable terminal device 3 is now explained.

When the portable terminal device 3 is loaded on the intermediate transmission device 2, the information input/output terminal 306 is connected to the information input/output terminal 205 of the intermediate transmission device 2, while the power input terminal 307 is connected to the power supply terminal 206 of the intermediate transmission device 2, to permit data communication with the intermediate transmission device 2 and to permit the power to be supplied from the power supply unit 210 of the intermediate transmission device 2.

Referring to FIG. 3, the portable terminal device 3 includes a controller 311 for controlling various parts of the portable terminal device 3, a ROM 312 having stored therein the program executed by the controller 311, a RAM 313 for transient data storage, a signal processing circuit 313 for reproducing and outputting audio data, an I/O port 317 for having communication with the intermediate transmission device 2, and a storage unit 320 for recording the information downloaded from the server device 1. The portable terminal device 3 also includes a speech recognition translation unit 321 for translating the first language lyric information into a second language lyric information, a speech synthesis unit 322 for generating the novel vocal information based on the second language lyric information, a display unit 301 and a key actuating unit 302 actuated by a user. These circuits are interconnected over a busline B3.

The controller 311 is constituted by, for example, a micro-computer, and controls the various circuits of the portable terminal device 3. In the ROM 312, there is stored the information necessary for the controller 311 to execute the required control processing and various databases etc. In the RAM 313, there are transiently stored data for communication with the intermediate transmission device 2 or data produced by processing by the controller 311.

Th I/O port 317 is provided for communication with the intermediate transmission device 2 via the information input/output terminal 306. The request information sent out from the portable terminal device 3 or the data downloaded from the server device 1 is inputted or outputted via this I/O port 317.

The storage unit 320 is made up of, for example, a hard disc device, and is adapted for storing the information downloaded via the intermediate transmission device 2 from the server device 1. There is no particular limitation to the recording medium used in the storage unit 320, such that random-accessible recording mediums, such as optical disc or a semiconductor memory, may be used.

The speech recognition translation unit 321 is fed with the vocal information transmitted along with the karaoke information after separation by the vocal separation unit 212 of the intermediate transmission device 2, and performs speech recognition of the vocal information to generate the letter information of the lyric sung by the original vocal singer (first language lyric information). If the vocal is sung in English, the speech recognition for English is made, such that the letter information by the lyric in English is obtained as the first language lyric information. The speech recognition translation unit 321 then translates the first language lyric information to generate the second language lyric information translated into a pre-set language from the first language lyric information. If Japanese is set as the second language, the first language lyric information is translated into the letter information by the lyric in Japanese.

The speech synthesis unit 322 first generates the novel vocal information (audio data) sung with the lyric of the as-translated second language, based on the second language lyric information generated by the speech recognition translation unit 321. By exploiting the original vocal information, transmitted to the portable terminal device 3, the vocal information having substantially equivalent characteristics as those of the original vocal information transmitted to the portable terminal device 3, that is the novel vocal information sung with the lyric translated into the second language, may be generated without impairing the sound quality of the original musical number. The speech synthesis unit 322 synthesizes the generated novel vocal information and the karaoke information corresponding to the novel vocal information, to generate the synthesized musical number information. The generated synthesized represents the musical number information sung with a language different from the language of the original musical number by the same artist.

Thus, with the portable terminal device 3 embodying the present invention, at least the karaoke information (audio data), the lyric information by two languages, that is the original language and the translated language (letter information data) and the synthesized musical number information sung with the second language (audio data) can be obtained as the derivative information. This information is stored in the storage unit 320 of the portable terminal device 3, along with other usual downloaded data, in a supervised state as the contents utilized by a user. The specified structures of the speech recognition translation unit 321 and the speech synthesis unit 322 will be explained subsequently.

The audio data read out from the storage unit 320 is fed via busline B3 to the signal processing circuit 314, which then performs pre-set signal processing on the supplied audio data. If the audio data stored in the storage unit 320 is encoded, e.g., compressed in a pre-set manner, the signal processing circuit 314 expands and decodes the supplied compressed audio data to send the obtained audio data to a D/A converter 315. The signal processing circuit 314 converts the audio data supplied from the signal processing circuit 314 to send the converted analog audio signals via audio output terminal 309 to, for example, a headphone 8.

The portable terminal device 3 is provided with a microphone terminal 310. If a microphone 12 is connected to the microphone terminal 310 to input the speech, an A/D converter 316 converts the analog speech signals supplied from the microphone terminal 310 from the microphone 12 into digital audio signals which are then sent to the signal processing circuit 314. The signal processing circuit 314 compresses or encodes the input digital audio signals in a manner suited to data writing in the storage unit 320. The encoded data from the signal processing circuit 314 is stored in the storage unit 320 under control by the controller 311. There are occasions wherein digital audio signals from the A/D converter 316 are directly outputted via D/A converter 315 at the audio output terminal 309 without being processed by the signal processing circuit 314 as described above.

The portable terminal device 3 is provided with an I/O port 318 which is connected via a connector 308 to an external equipment or device. To the connector 308 are connected a display device, a keyboard, a modem or a terminal adapter. These components will be explained subsequently as a specified use configuration of the portable terminal device 3.

The portable terminal device 3 includes a battery circuit portion 319 which is made up at least of a secondary battery and a power source circuit for converting the voltage of the secondary battery into a voltage required in each circuit in the interior of the portable terminal device 3, and feeds the respective circuits of the portable terminal device 3 by taking advantage of the secondary battery. When the portable terminal device 3 is loaded on the intermediate transmission device 2, the current for driving the respective circuits of the portable terminal device 3 and the charging current is supplied from the power source unit 210 via the power supply terminal 206 and the power source input terminal 307 to the battery circuit unit 319.

The display unit 301 and the key actuating unit 302 are provided on the main body portion of the portable terminal device 3, as described above, and the display control of the display unit 301 is performed by the key actuating unit 302. The controller 311 executes the required control operations based on the actuating information entered by the key actuating unit 302.

1-*c* Specified Structure of Vocal Separation Unit

Figure 4:
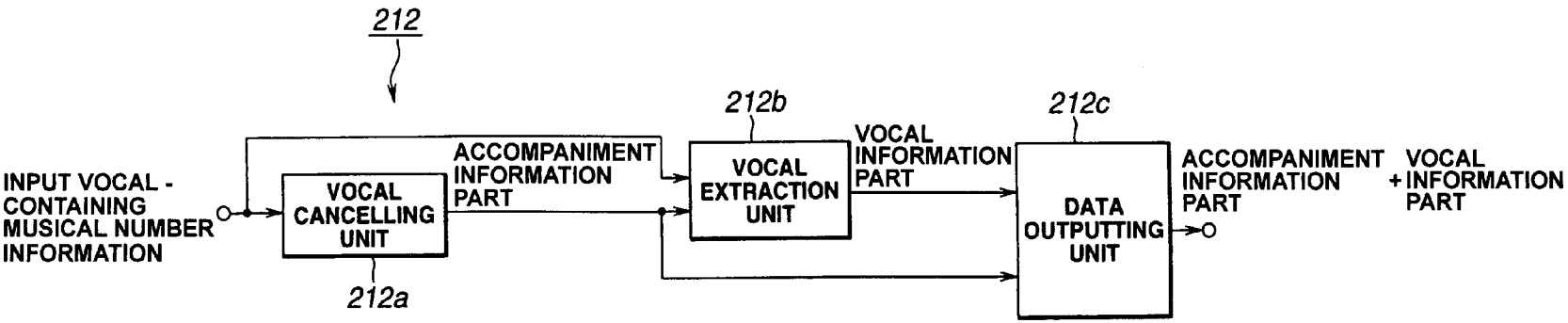
FIG. 4 is a block diagram showing a specified structure of a vocal separating unit.

FIG. 4 is a block diagram showing a specified structure of the vocal separation unit 212 provided on the intermediate transmission device 2. Referring to FIG. 4, the vocal separation unit 212 includes a vocal cancelling unit 212*a* for generating the karaoke information, a vocal extraction unit 212*a* for generating the vocal information and a data outputting unit 212*c* for generating the transmission data.

The vocal cancelling unit 212*a* includes, for example, a digital filter, and cancels (erases) the vocal part component from the input vocal-containing musical number information D1 (audio data) to generate the karaoke information D2, which is the audio data composed only of the accompaniment part, to send the generated data to the vocal extraction unit 212*b* and to the data outputting unit 212*c*. Although the detailed internal structure of the vocal cancelling unit 212*a* is omitted, the vocal cancelling unit 212*a* generates the karaoke information D2 using the well-known technique of cancelling the speech signals fixed at the center on stereo reproduction with the {(L channel data)–(R channel data)}. At this time, the signals of the frequency band containing the vocal speech are cancelled using a band-pass filter etc while cancellation of the signals of the accompaniment instruments is minimized.

The vocal extraction unit 212*b* executes the processing of [musical number information D1–karaoke information D2=vocal information D3], as a principle, based on the karaoke information D2 and the musical number information D1, to extract from the musical number information D1 the vocal information D3 which is audio data composed only of the vocal part to send the vocal information D3 to the data outputting unit 212*c*.

The data outputting unit 212*c* chronologically arrays the supplied karaoke information D2 and the vocal information D3 in accordance with a pre-set rule to output the arrayed data as transmission data (D2+D3). The transmission data (D2+D3) is sent from the intermediate transmission device 2 to the portable terminal device 3.

1-d Specified Structure of Speech Recognition Translation Unit

Figure 5:
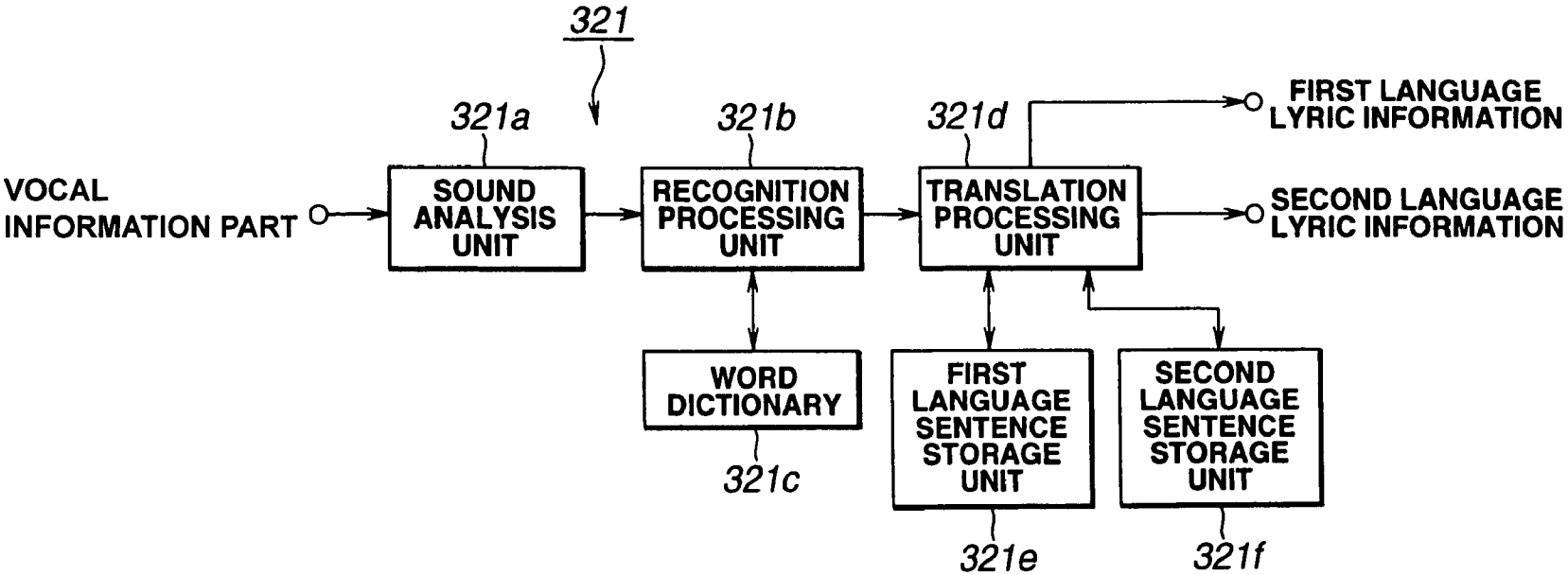
FIG. 5 is a block diagram showing a specified structure of a speech recognition translation unit.

FIG. 5 is a block diagram showing a specified structure of the speech recognition translation unit 321 provided in the portable terminal device 3. Referring to FIG. 5, the speech recognition translation unit 321 includes a sound analysis unit 321*a* for finding data concerning characteristic parameters of the vocal information D3, a recognition processing unit 321*b* for performing speech recognition of the vocal information D3 based on the data concerning characteristic parameters, and a word dictionary data unit 321*c* having words as object of speech recognition stored therein. The speech recognition translation unit 321 also includes a translation processing unit 321*d* for translating the vocal information D3 of a first language into a second language, a first language sentence storage unit 321*e* having data concerning the sentences or plural words by the original vocal language, and a second language sentence storage unit 321*f* having stored therein data concerning data the sentences or words translated into the target language.

The sound analysis unit 321*a* analyzes the sound of the vocal information D3 of transmission data (D2+D3) from the data outputting unit 212*c* of the intermediate transmission device 2, to extract data concerning the characteristic parameters of the speech, such as speech power, in terms of a pre-set frequency band as a unit, linear prediction coefficients (LPC) or Cepstrum coefficients. That is, the sound analysis unit 321*a* filters speech signals with ha filter bank in terms of a pre-set frequency band as a unit to rectify and smooth the filtering results to find data concerning the power of the speech on the pre-set frequency band basis. In addition, the speech recognition translation unit 321 processes the input speech data (vocal information D3) with linear prediction analysis to find linear prediction coefficients to find the cepstrum coefficients from the thus found linear prediction coefficients. The data concerning the characteristic parameters, thus extracted by the sound analysis unit 321*a*, is supplied to the recognition processing unit 321*b* directly or on vector quantization is so desired.

The recognition processing unit 321*b* performs word-based speech recognition of the vocal information D3, by having reference to the large-scale word dictionary data unit 321*c*, in accordance with the speech recognition algorithm, such as a dynamic programming (DP) matching method or hidden Markov model (HMN), based on data concerning characteristic parameters sent from the sound analysis unit 321*a* or data concerning symbols obtained on vector quantization of the characteristic parameters, to send the speech recognition results to the translation processing unit 321*d*. In the word dictionary data unit 321*c*, there is stored a reference pattern or a model of words (original vocal languages) as the object of speech recognition. The recognition processing unit 321*b* refers to the words stored in the w321*c* to execute the speech recognition.

The first language sentence storage unit 321*e* has numerous data on sentences or plural words in the original vocal language stored therein. The second language sentence storage unit 321*f* has stored therein data concerning the sentences or words obtained on translating the sentences or words stored in the first language sentence storage unit 321*e* into the target language. Thus, the data concerning the sentences or words of the language stored in the first language sentence storage unit 321*e* are related in a one-for-one correspondence with the data concerning the sentences or words of another language stored in the second language sentence storage unit 321*f*. Specifically, there is stored in, for example, the first language sentence storage unit 321*e*, along with data concerning the sentences or words in English, address data specifying the addresses of the second language sentence storage unit 321*f* holding the data concerning the sentences or words in Japanese corresponding to the data of the sentences or words in English. By using these stored addresses, it is possible to make instantaneous retrieval from the second language sentence storage unit 321*f* of data concerning the sentences or words in Japanese corresponding to the data of the sentences or words in English stored in the first language sentence storage unit 321*e*.

If one or more word strings are obtained by speech recognition by the recognition processing unit 321*b*, these are sent to the translation processing unit 321*d*. When fed with one or more words, as the result of speech recognition, from the recognition processing unit 321*b*, the translation processing unit 321*d* retrieves data concerning the sentence most similar to the combination of the words from sentence data in the language stored in the first language sentence storage unit 321*e*.

In the retrieval operation, the translation processing unit 321*d* retrieves first language sentence data, containing all of the words obtained on speech recognition (referred to hereinafter as recognized words), from the first language sentence storage unit 321*e*. If there exists the first language sentence data containing all words obtained on speech recognition, the translation processing unit 321*d* reads out from the first language sentence storage unit 321*e* the coincident first language sentence data as sentence data or word data strings bearing strongest similarity to the combination of recognized words. If there is no first language sentence data containing all of the recognized words in the first language sentence data stored in the first language sentence storage unit 321*e*, the translation processing unit 321*d* retrieves from the first language sentence storage unit 321*e* the first language sentence data containing the recognized words left over on excluding one of the recognized words. If there exists the first language sentence data containing the remaining recognized words, the translation processing unit 321*d* reads out coincident first language sentence data from the first language sentence storage unit 321*e* as the sentence data or the word data string bearing strongest similarity to the combination of the recognized words outputted by the translation processing unit 321*d*. If there is no first language sentence data containing the recognized words left over on excluding one of the recognized words, the translation processing unit 321*d* retrieves first language sentence data containing the recognized words left over on excluding two of the recognized words.

On retrieving the first language sentence data, bearing the strongest similarity to the combination of the recognized words from the first language sentence storage unit 321*e* as described above, the translation processing unit 321*d* concatenates the retrieved first language sentence data, to output the concatenated data as the first language lyric information. This first language lyric information is stored in the storage unit 320 as one of the contents of the derivative information.

The translation processing unit 321*d* utilizes address data stored along with the first language sentence data obtained on retrieval to retrieve the second language sentence data associated with the first language sentence data from the second language sentence storage unit 321*f* to execute association processing. The translation processing unit 321*d* concatenates the second language sentence data on the recognition word basis in accordance with a pre-set rule, that is the grammar of the second language, to generate the letter information of the lyric, in order to generate the letter information of the lyric translated from the first language to the second language. The translation processing unit 321*d* outputs the letter information of the lyric translated into the second language data as the second language lyric information. Similarly to the first language lyric information, the second language lyric information is stored as one contents of the derivative information in the storage unit 320 and is sent to the speech synthesis unit 322 as now explained.

1-e Specified Structure of Speech Synthesis Unit

Figure 6:
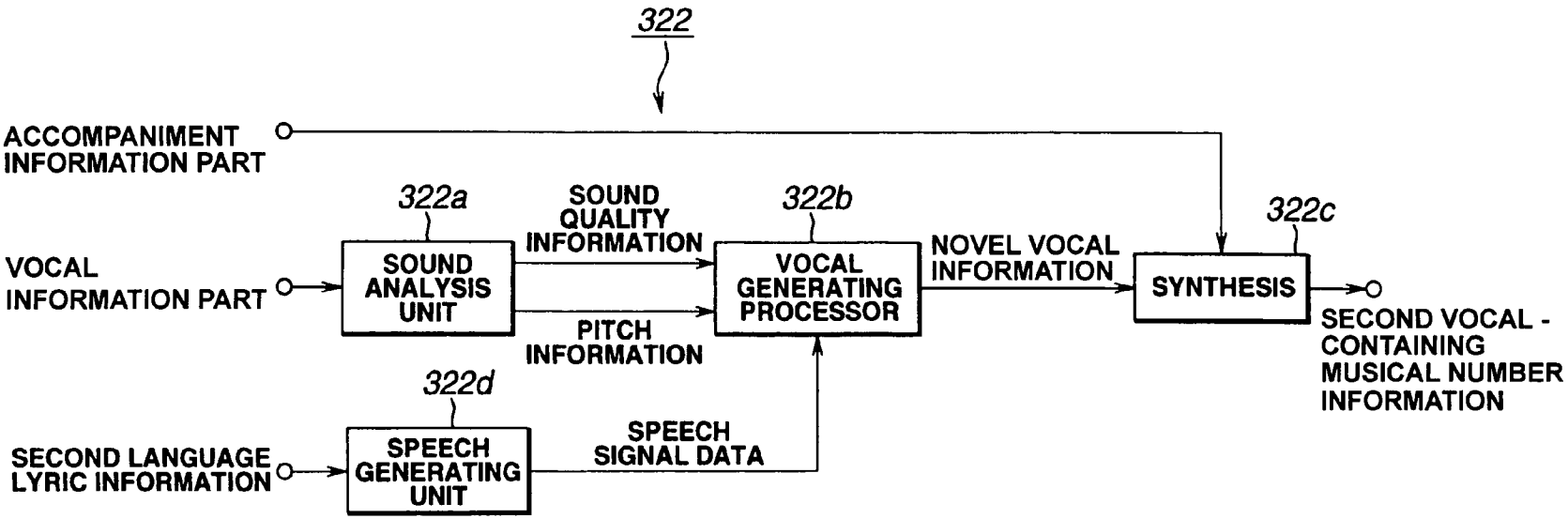
FIG. 6 is a block diagram showing a specified structure of a speech synthesis unit.

FIG. 6 is a block diagram showing a specified structure of the speech synthesis unit 322 provided in the portable terminal device 3. Referring to FIG. 6, the speech synthesis unit 322 includes a speech analysis unit 322*a* for generating pre-set parameters of the vocal information D3, a vocal generating processor 322*b* for generating the novel vocal information, a synthesis unit 322*c* for synthesizing the karaoke information D2 and the novel vocal information, and a speech synthesis unit 322*d* for synthesizing the speech signal data by the second language.

The speech analysis unit 322*a* analyzes the vocal information D3 supplied thereto with a required analysis processing (waveform analysis processing etc) to generate pre-set parameters (sound quality information) characterizing the voice quality of the vocal as well as the pitch information of the vocal along the time axis (that is, the melody information of the vocal part), to send the information to the vocal generating processor 322*b*.

The vocal generating processor 322*d* performs speech synthesis by the second language, based on the second language lyric information supplied thereto, to send the speech signal data obtained by this synthesis processing (speech signals pronouncing the lyric in the second language) to the vocal generating processor 322*b*.

The vocal generating processor 322*b* processes the sound quality information supplied from the speech analysis unit 322*a* with the waveform deforming processing to perform the processing so that the voice quality of the speech signal data sent from the speech synthesis unit 322*d* will be equated to the same voice quality of the vocal of the vocal information D3. That is, the vocal generating processor 322*b* generates speech signal data pronouncing the lyric with the second language while having the voice quality of the vocal of the vocal information D3 (second language pronunciation data). The vocal generating processor 322*b* then performs the processing of according the scale (melody) to the generated second language pronunciation data based on the pitch information sent from the speech analysis unit 322*a*. Specifically, the vocal generating processor 322*b* suitably demarcates the second language pronunciation data based on the timing code attached to the speech signal data and the pitch information in a certain previous processing stage, matches the melody demarcation to the lyric demarcation and accords to the second language pronunciation data the scale which is based on the pitch information. The speech signal data, thus generated, represents the vocal information having the same sound quality and the same melody as the original artist of the musical number and which is sung with the lyric of the second language following the translation. The vocal generating processor 322*b* sends this vocal information as a novel vocal information D4 to the synthesis unit 322*c*.

The synthesis unit 322*c* synthesizes the karaoke information D2 supplied thereto and the novel vocal information D4 to generate the synthesized musical number information D5 which is outputted. The synthesized musical number information D5 psychoacoustically differs from the original musical number information D1 in that it is being sung with the lyric of the second language following the translation, while the voice quality of the artist of the vocal part or the sound quality of the accompaniment part is approximately equal to that of the original musical number.

1-f Basic Downloading Operation and Typical Utilization of Downloading Operation Referring to FIGS. 1 to 3, the basic operation of the data downloading for the portable terminal device in the information distribution system embodying the present invention is explained.

For downloading the desired information, such as the musical-number-based data if the data is the audio data of musical numbers, to the portable terminal device 3 owned by the user, the user has to select the information to be downloaded. This selection of the information for downloading is by the following method:

That is, the user actuates a pre-set key of the key actuating unit 302 provided on the portable terminal device 3 (see FIGS. 1 and 2). For example, the information that is able to be downloaded by the information distribution system is stored in the storage unit 320 in the portable terminal device 3 as the menu information in the form of a database. This menu information is stored, when certain information was previously downloaded by exploiting the information distribution system, along with the downloaded information.

The user of the portable terminal device 3 acts on the key actuating unit 302 to cause the menu screen for information selection on the display unit 301, based on the menu information read out from the storage unit 320, and acts on the selection key 303 to select the desired information to determine the selected information by the decision key 304. It is also possible to use a jog dial in place of the selection key 303 and the decision key 304 and to selectively rotate the jog dial to make the decision on thrusting the jog dial. This assures facilitated operation at the time of selective actuation.

If the above-described selective setting operation is done with the portable terminal device 3 attached to the intermediate transmission device 2, the request information is transmitted from the portable terminal device 3 via the intermediate transmission device 2 (interfacing unit 209) and the communication network 4 to the server device 1. On the other hand, if the above-described selective setting operation is done with the portable terminal device 3 not attached to the intermediate transmission device 2, the request information is stored in the RAM 313 in the portable terminal device 3 (see FIG. 3). When the user loads the portable terminal device 3 on the intermediate transmission device 2, the request information stored in the RAM 313 is transmitted via the intermediate transmission device 2 and the communication network 4 to the server device 1. That is, even in an environment in which the intermediate transmission device 2 is not on hand, the user is able to perform the operation of selecting the above-described information at an opportune moment in advance to keep the request information corresponding to this operation on the portable terminal device 3.

In the above-described embodiment, the information selection and setting operation is by the key actuating unit 302 provided on the portable terminal device 3. It is however possible to provide the key actuating unit 202 on the intermediate transmission device 2 to permit the above-described operation to be performed by the key actuating unit 202 of the intermediate transmission device 2.

When the selective setting operation is performed by any of the above-described method, and the portable terminal device 3 is loaded on the intermediate transmission device 2, the request information corresponding to the selective setting operation is uploaded from the portable terminal device 3 via the intermediate transmission device 2 to the server device 1. This uploading may be done with the results of detection by the attachment verification unit 211 of the intermediate transmission device 2 operating as a starting trigger. If the request information is sent from the intermediate transmission device 2 to the server device 1, terminal ID data stored in the portable terminal device 3 is transmitted along with the request information.

If the server device 1 receives the request information from the portable terminal device 3 and the terminal ID data, the collation processing unit 104 first collates the terminal ID data transmitted along with the request information. If, as a result of the collation, the server device 1 verifies that the terminal ID data can use the information distribution system, the server device 1 performs the operation of retrieving the information corresponding to the transmitted request information from the information stored in the storage unit 103. This retrieving operation is done by the controller 101 controlling the retrieval unit 103 to collate the identification code contained in the request information to the identification code accorded to each information stored in the storage unit 102. In this manner, the information corresponding to the retrieved request information becomes the information to be distributed from the server device 1.

If, in the above-described terminal ID data collating operation, the transmitted terminal ID data is verified to be unable at the present time to use the information distribution system, for such reasons that the transmitted terminal ID data is not registered in the server device 1, or that the remainder in the bank account of the owner of the portable terminal device 3 is in deficit, the error information specifying the contents may be transmitted to the intermediate transmission device 2. It is also possible to indicate an alarm on the display unit 301 of the portable terminal device 3 and/or on the display unit 203 of the intermediate transmission device 2, based on the transmitted error information, or to provide a speech outputting unit, such as a speaker, on the intermediate transmission device 2 or on the portable terminal device 3, to output an alarm sound.

The server device 1 transmits the information coincident with the transmitted request information, retrieved from the storage unit 102, to the intermediate transmission device 2. The portable terminal device 3, attached to the intermediate transmission device 2, acquires the information received by the intermediate transmission device 2, via the information input/output terminal 205 and the information input/output terminal 306, to save (download) the acquired information in the internal storage unit 320.

During the time the information from the server device 1 is being downloaded to the portable terminal device 3, the secondary battery of the portable terminal device 3 is automatically charged by the intermediate transmission device 2. Since there may arise a situation in which, as the intention of the user of the portable terminal device 3, the information downloaded is not required, and the intermediate transmission device 2 is desired to be used only for electrically charging the battery of the portable terminal device, it is possible to perform only the electrical charging of the secondary battery of the portable terminal device 3 by attaching the portable terminal device 3 on the intermediate transmission device 2 to perform the pre-set operation.

If the downloading of the information on the portable terminal device 3 comes to a close in the manner as described above, there is displayed a message indicating the end of the information downloading on the display unit 203 of the intermediate transmission device 2 or on the display unit 302 of the portable terminal device 2.

If the user of the portable terminal device 3 verifies the display indicating the end of the downloading, and detaches the portable terminal device 3 from the intermediate transmission device 2, the portable terminal device 3 operates as a reproducing device for reproducing the information downloaded on the storage unit 320. That is, if the user owns only the portable terminal device 3, he or she may reproduce and display the information stored in the portable terminal device 3, output the stored information as the speech or hear the information. In this case, the user can operate the actuating keys 305 provided on the portable terminal device 3 to switch the information reproducing operation. The actuating keys 305 may, for example, be a fast feed, playback, rewind, stop or pause keys.

Figure 7:
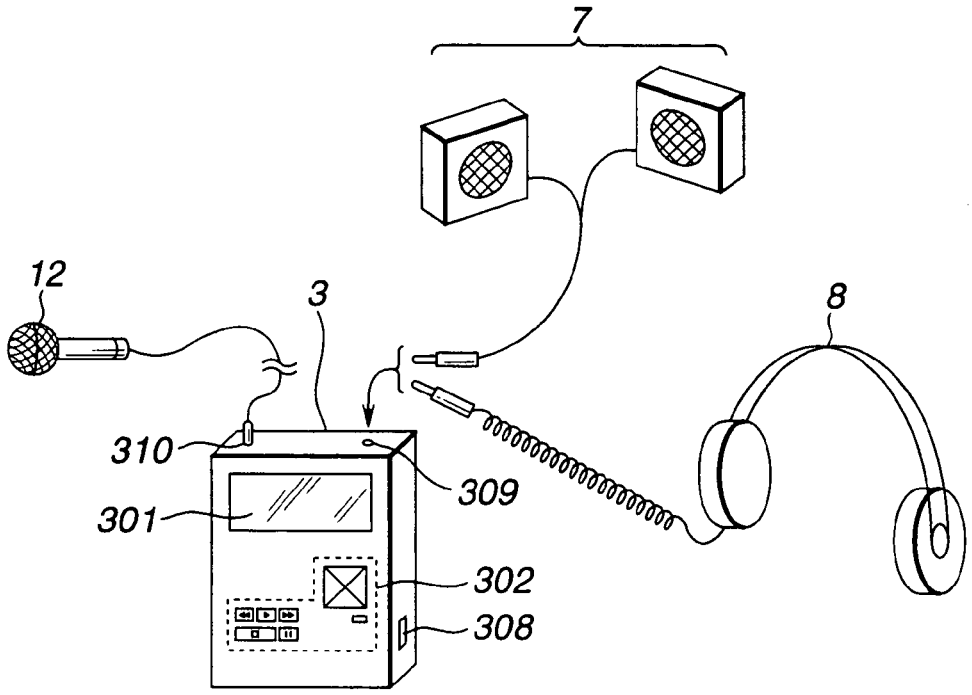
FIG. 7 is a perspective view showing a specified configuration of utilization of a portable terminal device.

If, for example, the user intends to reproduce and hear the audio data of the information stored in the storage unit 320, he or she may connect speaker devices 7, a headphone 8 etc to an audio output terminal 309 of the portable terminal device 3 to convert the reproduced audio data into speech, in order to hear the as-converted speech, as shown in FIG. 7.

Also, the microphone 12 may be connected to a microphone terminal 310 to convert the analog speech signals outputted by this microphone 12 into digital data for storage in the storage unit 320, as shown in FIG. 7. That is, the speech entered from the microphone may be recorded. In this case, a recording key is provided as the above-mentioned actuating keys 305.

Moreover, the karaoke information may be reproduced and outputted as audio data from the portable terminal device 3 so that the user can sing a song, to the accompaniment of the karaoke being reproduced, using the microphone 12 connected to the microphone terminal 310.

Figure 8:
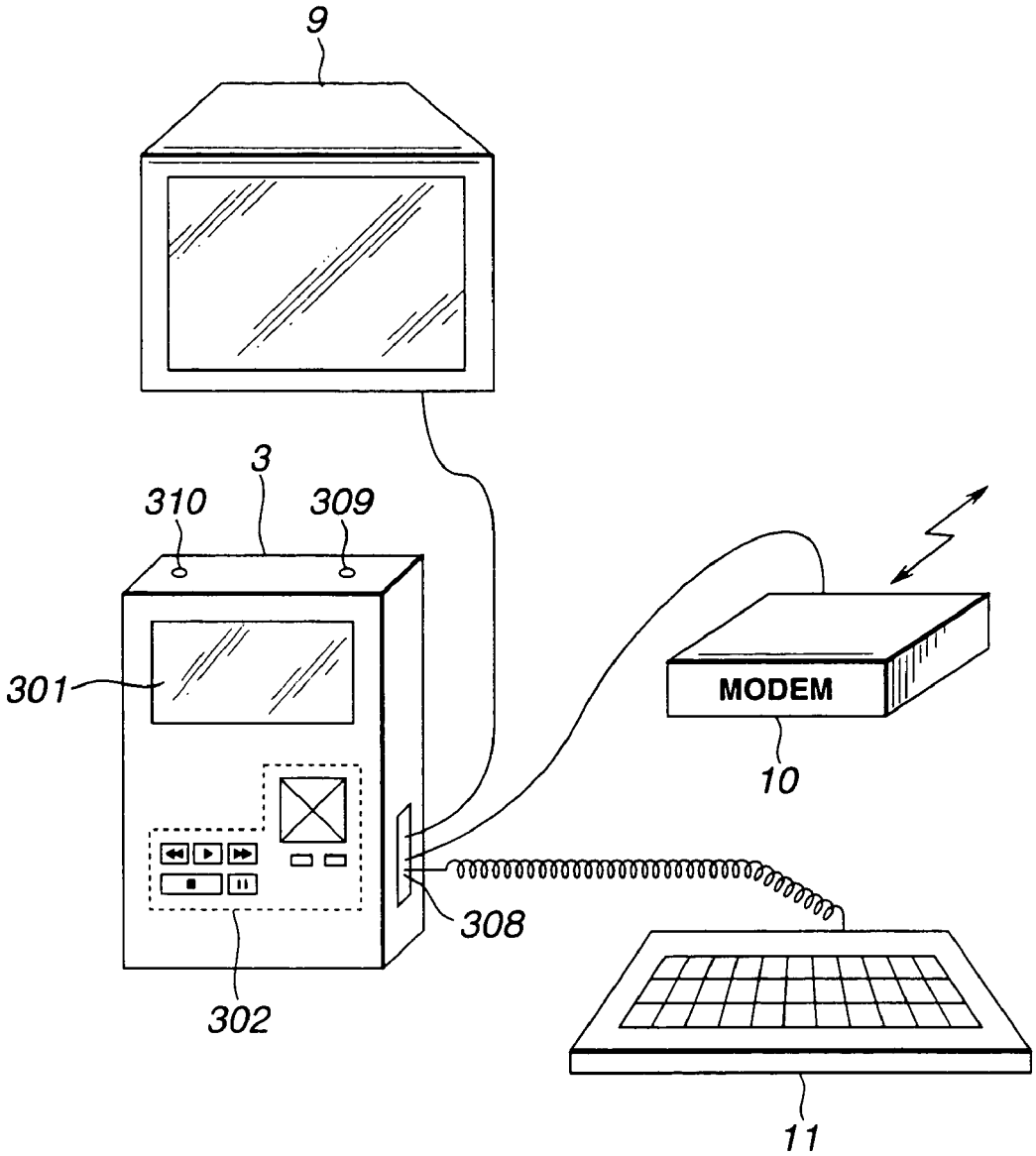
FIG. 8 is a perspective view showing another specified configuration of utilization of a portable terminal device.

Referring to FIG. 8, a monitor display device 9, a modem 10 (or a terminal adapter) or a keyboard 11 may be connected to a connector 308 provided on the main body portion of the portable terminal device 3. That is, downloaded picture data etc may be displayed on, for example, the display device 301 of the portable terminal device 3. However, if an external monitor display device 9 is connected to the connector 308 to output picture data from the portable terminal device 3, it is possible to view the picture on a large-format screen. Also, if the keyboard 22 is connected to the connector 308 to enable letter inputting, the inputting of the request information for selecting the request information, that is for selecting the information to be downloaded from the server device 1, is facilitated. In addition, it is possible to input a more complex command. If the modem connector (terminal adapter) 10 is connected to the connector 308, it is possible to exchange data with the server device 1 without utilizing the intermediate transmission device 2. Depending on the program held in the ROM 312 of the portable terminal device 3, it is possible to have communication with another computer or another portable terminal device 3 over the communication network 4 and hence to assure facilitated data exchange between users. If a radio connection controller is used in place of the connection by the connector 308, it is possible to interconnect the intermediate transmission device 2 and the portable terminal device 3 over a radio path.

2. Downloading of Derivative Information

Figure 9:
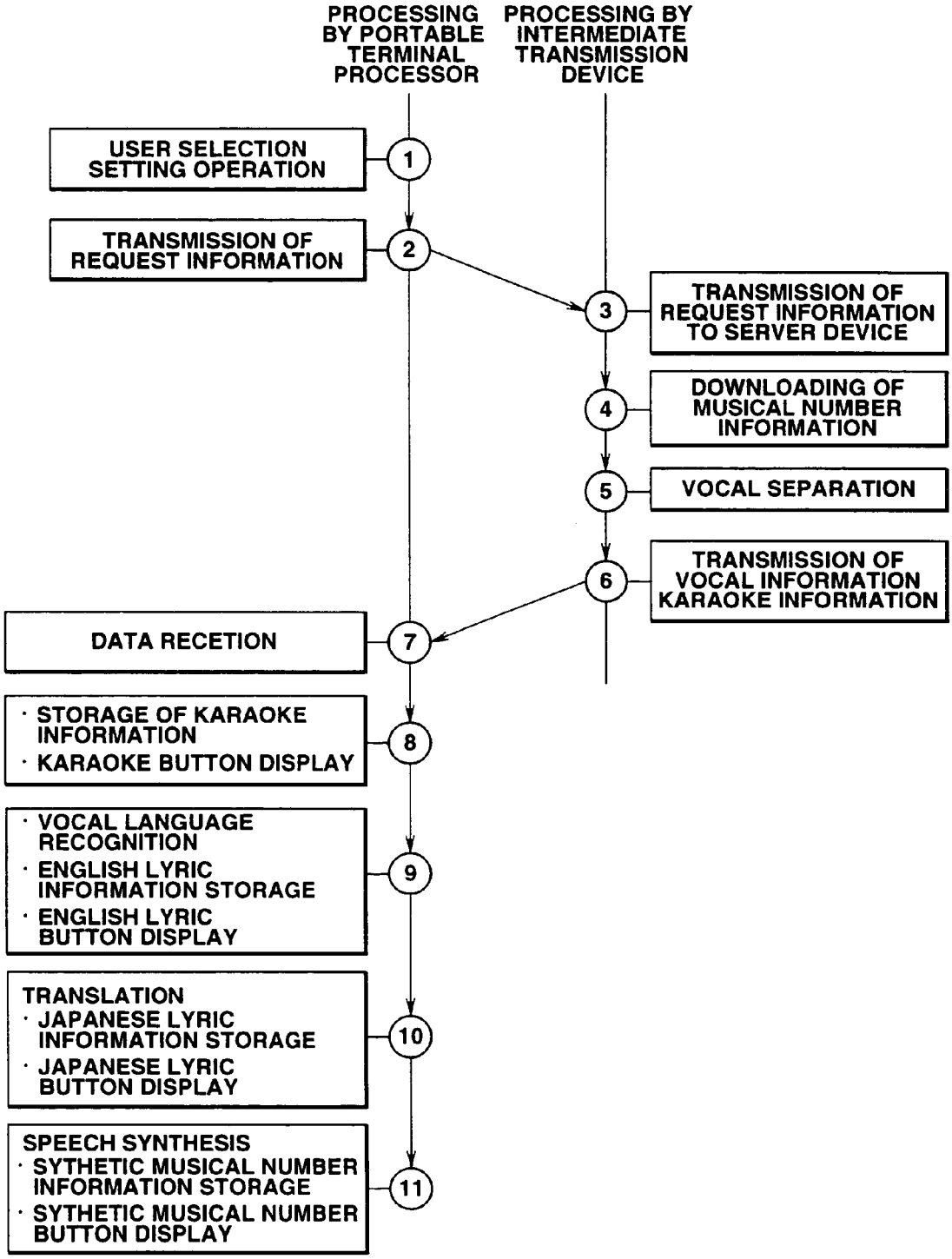
FIG. 9 illustrates the operation of the intermediate transmission device and the portable terminal device when downloading the derivative information with lapse of time.

Referring to FIGS. 9 and 10, the downloading of the derivative information, predicated on the above-described structure of the information distribution system, basic operation of the information downloading for the portable terminal device and the exemplary use configuration are hereinafter explained. FIGS. 9 and 10 illustrate the process of the operation of the intermediate transmission device 2 and the portable terminal device 3 for downloading the derivative information along the time axis and the display contents of the display unit 301 of the portable terminal device 3 with time lapse of the downloading of the derivative information, respectively.

The derivative information herein means the karaoke information, obtained from the vocal-containing original music number information, first language lyric information, second language lyric information and the synthesized music number information sung by he same artist with the second language.

As for the detailed operation of the respective devices making up the information distribution system when downloading the derivative information, namely the server device 1, intermediate transmission device 2 and the portable terminal device 2, since the basic operation at the time of downloading is already explained with reference to FIG. 3, and the operation for generating the derivative information is already explained with reference to FIGS. 4 to 6, detailed description of the information distribution system is omitted with the exception of certain supplementations, and mainly the operation of the intermediate transmission device 2 and the portable terminal device 3 with lapse of time is explained.

FIG. 9 shows the operation of the intermediate transmission device 2 and the portable terminal device 3 at the time of downloading of the derivative information. In FIG. 9, arabic numerals in circle marks denote the sequence of the operations of the intermediate transmission device 2 and the portable terminal device 3 taking place with lapse of time. The following explanation is made in the sequence indicated by these numbers.

Operation 1: The user acts on the key actuating unit 302 of the portable terminal device 3 to execute the selective setting operation for downloading the desired derivative information of the musical number information. Thus, the portable terminal device 3 generates the request information, that us the information requesting the derivative information of the specified musical number information. It is also possible to make a similar selective setting operations using the key actuating unit 203 provided on the intermediate transmission device 2.

Operation 2: The portable terminal device 3 transmits and outputs the request information obtained as a result of the operation 1.

Operation 3: If fed with the request information from the portable terminal device 3, the intermediate transmission device 2 sends the request information over the communication network 4 to the server device 1. Although not shown in FIG. 9, the server device 1 retrieves and reads out the musical number information corresponding to the received request information from the storage device 102 to route the read-out musical number information to the intermediate transmission device 2. Meanwhile, even if the request information demands the derivative information, the musical number information distributed from the server device 1 is the original musical number information, with the derivative information not being produced in this stage. In FIG. 9, the operation up to this stage is the operation 3.

Operation 4: The intermediate transmission device 2 receives the musical number information sent from the server device 1 for transient storage in the storage unit 208. That is, the musical number information is downloaded to the intermediate transmission device 2.

Operation 5: The intermediate transmission device 2 reads out the menu stored in the storage unit 208 to send the read-out information to the vocal separation unit 212, which then separates the musical number information D1 into the karaoke information D2 and the vocal information D3, as explained with reference to FIG. 4.

Operation 6: The vocal separation unit 212 outputs the karaoke information D2 and the vocal information D3 as the transmission information (D2+D3) from the data outputting unit 212*c* of the last stage, as already explained with reference to FIG. 4. That is, the intermediate transmission device 2 sends the transmission information (D2+D3) to the portable terminal device 3.

Operation 7: Thus, in the present embodiment, the operation of obtaining the derivative information in the intermediate transmission device 2 is only the processing for generating the karaoke information D2 and the vocal information D3 by the signal processing by the vocal separation unit 212. That is, the processing for generating the various derivative information downstream of the karaoke information D2 and the vocal information D3 is performed in its entirety by the portable terminal device 3 based on the sum of the karaoke information D2 and the vocal information D3 (transmission information D2+D3) supplied from the intermediate transmission device 2. Stated differently, the intermediate transmission device 2 and the portable terminal device 3 perform respective rolls in producing the various derivative information as the contents for the user. This relieves the processing load imposed on the intermediate transmission device 2 and the portable terminal device 3 as compared to the case when one of the intermediate transmission device 2 or the portable terminal device 3 performs the function of generating the derivative information.

Operation 7: The portable terminal device 3 receives the transmission information (D2+D3) generated and transmitted by the intermediate transmission device 2 at the operation 6.

Figure 10A:
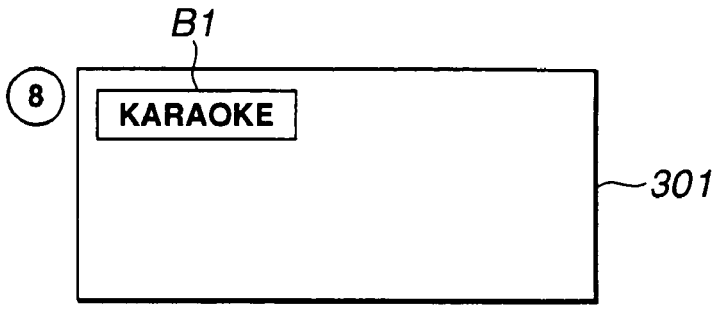
FIGS. 10A to 10D illustrate a typical display on a display unit of a portable terminal device 3 when downloading the derivative information.
Figure 10B:
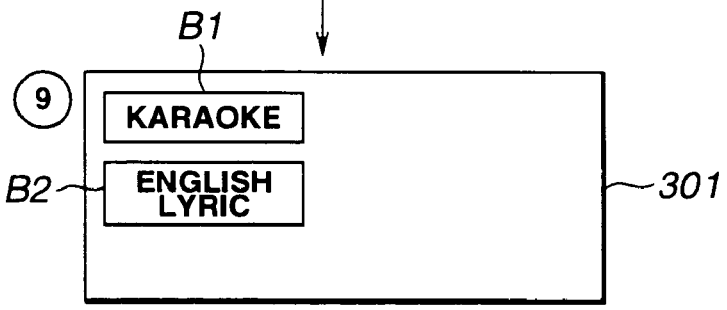
Figure 10C:
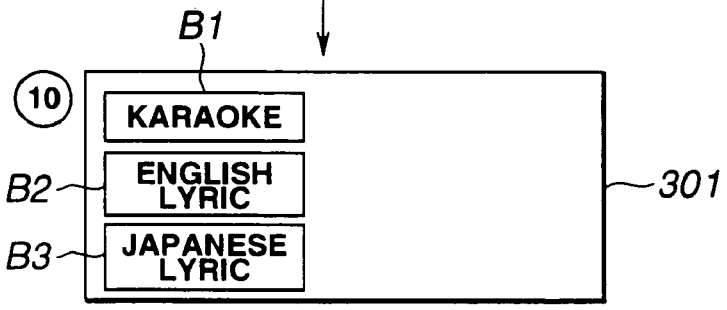

Operation 8: Of the karaoke information D2 and the vocal information D3, making up the received information (D2+D3), the karaoke information D2 is first stored by the storage unit 320 of the portable terminal device 3. If the karaoke information D2 is stored in the storage unit 320, the portable terminal device 3 first acquires the karaoke information D2 as the contents of the derivative information. Thus, the portable terminal device 3 causes the karaoke button B1 to be indicated on the display device 301, as shown in FIG. 10A. The button indication on the display device 301 is sequentially displayed each time the portable terminal device 3 acquires the new derivative information, in order to apprise the user of the process of downloading of the derivative information. The button indications are also used as images for operation for the user to select and reproduce the desired contents. The same applies for the additional button indications as explained with reference to FIGS. 10B to 10D. On the other hand, the vocal information D3 of the received transmission information (D2+D3) is routed to the speech recognition translation unit 321.

Operation 9: The speech recognition translation unit 321 first performs the speech recognition of the input vocal information D3 to generate the (letter information) as the derivative information. It is assumed here that English has been set as the first language, that is as the vocal language of the musical number information. Therefore, the first language lyric information generated here is the lyric information in English. The lyric information in English, generated by the speech recognition translation unit 321, is stored in the storage device 320. If the first language lyric information is stored in the storage unit 320, the portable terminal device 3 acquires the second derivative information, so that the English lyric button B2 specifying that the lyric information in English has become the contents is displayed on the display unit 301.

Operation 10: The speech recognition translation unit 321 translates the first language lyric information (lyric information in English) generated by the operation 9 to generate the second language lyric information. It is assumed that Japanese is set as the second language. Thus, the second language lyric information actually produced is the lyric information translated from English into Japanese (Japanese lyric information). The portable terminal device 3 stores the Japanese lyric information as the third acquired derivative information in the storage unit 320. The Japanese lyric button B3, specifying that the Japanese lyric information has become the contents, is displayed on the display unit 301, in the same way as described above, as shown in FIG. 10.

Figure 10D:
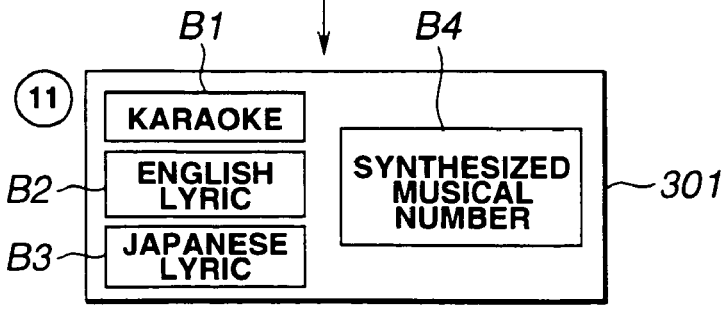

Operation 11: By the signal processing by the speech synthesis unit 322, the portable terminal device 3 generates the synthesized musical number information D5. This synthesized musical number information D5 is generated using the karaoke information D2, vocal information D3 and the second language lyric information (in this case, the Japanese lyric information) generated by the operation 10, as already explained with reference to FIG. 6. Since the first and second languages are English and Japanese, respectively, the generated synthesized musical number information D5 is the information of the musical number corresponding to the original number in English now sung in Japanese translation by the same artist. The portable terminal device 3 stores the generated synthesized musical number information D5 as the last acquired derivative information in the storage unit 320 and the synthesized music number button B4 is displayed in the display unit 301 for indicating that the synthesized musical number information has now been turned into contents, as shown in FIG. 10D.

In this stage, all of the four sorts of the contents that can be acquired as the derivative information are displayed as buttons on the display unit 301 to indicate that the downloading of the derivative information in its entirety has come to a close. In addition, a message specifying the end of the downloading may also be displayed. In actuality, the entire derivative information described above has been recorded in the storage unit 320 of the portable terminal device 3. The derivative information downloaded to the portable terminal device 3 is outputted and used in an external equipment or device as explained for example with reference to FIGS. 7 and 8.

It should be noted that the present invention is not limited to the above-described embodiments and may be suitably modified as to details. For example, in the explanation with reference to FIG. 9, the processing from the downloading of the musical number information up to the acquisition of the derivative information is a temporally consecutive sequence of operations. It is however possible to store at least the transmission information (karaoke information D2+vocal information D3) in the storage unit 320 of the portable terminal device 3 and to generate the three contents of the derivative information other than the karaoke information D2 in the portable terminal device 3 by a pre-set operation by the user at an optional opportunity after disengaging the portable terminal device 3 from the intermediate transmission device 2.

Also, in the explanation with reference to FIG. 9, it is assumed that the original English lyric information is translated into the Japanese information to produce the ultimate synthesized musical number information. However, the original language (first language) and the translation language (second language) are not limited to those shown in the above examples. It is also possible to get plural languages accommodated so that the translation language will be selected from the plural languages by the designating operation by the user. In this case, the number of languages stored in the first language sentence storage unit 321*e* and in the second language sentence storage unit 321*f* is increased depending on the number of the languages under consideration.

In the above-described downloading operation of the derivative information, the original musical number information is not contained in the contents obtained by the portable terminal device 3. However, in transmitting the transmission information (D2+D3) composed of the karaoke information D2 and the vocal information D3, it is possible to transmit the original musical number information D1 for storage in the storage unit 320 of the portable terminal device 3.

In the explanation with reference to FIG. 9, it is assumed that all of the four different sorts of the derivative information are acquired automatically on request of the derivative information concerning the musical number information. It is however possible to generate at least one of the four different sorts of the derivative information depending on the selective setting operation by the user. Alternatively, the only one of the four sorts of the derivative information is adapted to be supplied to simplify the information distribution system. That is, if only the karaoke information is furnished as the derivative information, it suffices if a circuit equivalent to the vocal cancelling unit 212*a* of the vocal separation unit 212 is provided in one of the devices making up the information distribution system.

Also, in the above-described embodiment, only the vocal separation unit 212 is provided as a circuit for generating the derivative information, while the remaining speech recognition translation unit 321 and speech synthesis unit 322 are provided in the portable terminal device 3. The present invention is, however not limited to this configuration since it depends on the actual designing and conditions how these circuits are allocated to the respective devices making up the information distribution system, that is the server device 1, intermediate transmission device 2 and the portable terminal device 3.

INDUSTRIAL APPLICABILITY

In the information distribution system according to the present invention, as described above, the musical number information of an original number distributed from the server device may be utilized to generate the karaoke information for the musical number, the lyric information of the vocal of the original language, the vocal lyric information translated into other languages and the synthesized musical number information sung in a translation language with the same vocal as that of the original music number to store the generated information in the portable terminal device. Since this turns not only the original musical number information but also the derivative information generated from the original musical number information into contents of the portable terminal device, it is possible to raise the value of the information distribution system in actual application.

What is claimed is:

1. An information processing apparatus comprising:

a vocal separation unit for separating a first vocal information part in a first language and a non-vocal accompaniment information part from input first vocal-containing musical number information;

a processing unit for generating first language lyric information by speech recognition of the first vocal information part in the first language separated by said separation unit, for translating the generated first language lyric information in the first language into second language lyric information of a second language different from the first language, and for supplying the second language lyric information; and a synthesis unit for synthesizing the second language lyric information supplied from the processing unit, the non-vocal accompaniment information part, and the first vocal information part separated by said separation unit to generate second vocal-containing musical number information, wherein the second vocal-containing musical number information includes the non-vocal accompaniment information part and a second vocal information part in the second language.

2. The information processing apparatus according to claim 1, wherein said processing unit includes a first processor for performing speech recognition of the first vocal information part separated by said separation unit and for generating the first language lyric information.

3. The information processing apparatus according to claim 2, wherein said processing unit further includes a second processor for performing a translation from the first language to the second language.

4. The information processing apparatus according to claim 3, wherein said second processor includes a first language storage unit having stored therein plural word data or plural sentence data of the first language of the first language lyric information, and a second language storage unit having stored therein plural word data or plural sentence data of the second language the second language of lyric information, said first language storage unit having stored therein address data specifying an address of the second language storage unit having stored therein the word data or sentence data of the second language associated with the word data or sentence data for the first language sorted in said first language storage unit.

5. The information processing apparatus according to claim 4, wherein said second processor reads out from the first language storage unit plural word data or sentence data closest to a combination of words speech-recognized by said first processor along with the address data, to generate the first language lyric information, said second processor reading out based on the address data the word data or sentence data from the second language storage unit to generate said second language lyric information.

6. The information processing apparatus according to claim 2, wherein said first processor is a speech recognition processing unit.

7. The information processing apparatus according to claim 6, wherein said speech recognition processing unit includes a word dictionary data unit.

8. The information processing apparatus according to claim 7, wherein said speech synthesis unit includes a sound analysis unit for analyzing the first vocal information part separated by said separation unit.

9. The information processing apparatus according to claim 1, further comprising a display unit for displaying a processing state of said processing unit.

10. The information processing apparatus according to claim 9, wherein said display unit displays at least the fact that the accompaniment information part has been read and the fact that said first and/or second language lyric information has been generated.

11. The information processing apparatus according to claim 1 further comprising a storage unit for storing the accompaniment information separated by said separation unit, the first language lyric information, the second language lyric information, and the second vocal-containing musical information generated by said synthesis unit.

12. The information processing apparatus according to claim 1 further comprising:

a first device; and a second device removably connected to said first device, wherein said first device includes said separation unit and said second device including said processing unit and said synthesis unit.

13. An information processing method comprising the steps of:

separating a first vocal information part in a first language and non-vocal accompaniment information part from input first vocal-containing musical number information;

generating first language lyric information in the first language by speech recognition of the separated first vocal information part;

converting the generated first language lyric information into second language lyric information in a second language different from the first language; and synthesizing the second language lyric information, the separated non-vocal accompaniment information part, and the separated first vocal information part to generate second vocal-containing musical number information, wherein the second vocal-containing musical number information includes the non-vocal accompaniment information part and a second vocal information part in the second language.

14. The information processing method according to claim 13, wherein the speech recognition used in generating the first language lyric information is performed in terms of words contained in a word dictionary data unit.

15. The information processing method according to claim 14, wherein plural word data or plural sentence data of the first language corresponding to the first language lyric information are stored in a first language storage unit;

plural word data or plural sentence data of the second language corresponding to the second language lyric information are stored in a second language storage unit; and wherein in said first language storage unit, there is stored address data indicating the address of the second language storage unit in which is stored the word data or sentence data for the second language corresponding to the word data or sentence data for the first language stored in said fist language storage unit;

in generating said first language lyric information, plural word data or sentence data closest to the combination of speech-recognized words are read out from the first language storage unit along with the address data to generate the first language letter information; and in generating the second language letter information, word data or sentence data is read out from the second language storage unit to generate the second language lyric information based on the address data read out along with the word data or sentence data from the first language storage unit to generate said second language lyric information.

16. The information processing method according to claim 13 wherein the synthesizing step includes a sound analysis unit for analyzing the separated first vocal information part.

17. The information processing method according to claim 16, wherein the synthesizing step includes a speech recognition processing unit.

18. The information processing method according to claim 13, wherein the synthesizing step includes displaying a processing state.

19. The information processing method according to claim 18, wherein the step of displaying a processing state displays at least the fact that the accompaniment information part has been read and the fact that said first and/or second language lyric information has been generated.

* * * * *